US009409745B2

(12) United States Patent
Walgenwitz et al.

(10) Patent No.: US 9,409,745 B2
(45) Date of Patent: Aug. 9, 2016

(54) CORE INTENDED TO BE USED AS A SUPPORT FOR A ROLL OF PAPER

(71) Applicant: SCA Tissue France, Saint-Ouen (FR)

(72) Inventors: Herve Walgenwitz, Sierentz (FR); Julien Marietta-Tondin, Marckolsheim (FR); Pierre Probst, Ammerschwihr (FR); Benoit Hoeft, Bischwihr (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 0 days.

(21) Appl. No.: 14/589,737

(22) Filed: Jan. 5, 2015

(65) Prior Publication Data

US 2015/0122938 A1 May 7, 2015

Related U.S. Application Data

(63) Continuation of application No. 12/601,448, filed as application No. PCT/FR2008/000826 on Jun. 13, 2008, now Pat. No. 8,961,721.

(30) Foreign Application Priority Data

Jun. 14, 2007 (FR) ..... 07 04233

(51) Int. Cl.
*B65H 75/10* (2006.01)
*A47K 10/16* (2006.01)

(52) U.S. Cl.
CPC ..... *B65H 75/10* (2013.01); *A47K 10/16* (2013.01); *B65H 2701/5112* (2013.01)

(58) Field of Classification Search
CPC ..... A47K 10/16; B65H 75/02; B65H 75/08; B65H 75/10; Y10T 156/1036; Y10T 156/1038
See application file for complete search history.

(56) References Cited

U.S. PATENT DOCUMENTS 3,034,922 A * 5/1962 Boe ..... 162/158
3,399,095 A 8/1968 Hyland, Jr.

(Continued)

FOREIGN PATENT DOCUMENTS

GB 2401870 A 11/2004
JP 9118478 5/1997
WO WO-2007030749 A1 3/2007

OTHER PUBLICATIONS

English Abstract for JP9118478; Publication date: May 6, 1997; One page.

(Continued)

*Primary Examiner* — Carson Gross
(74) *Attorney, Agent, or Firm* — Drinker Biddle & Reath LLP

(57) ABSTRACT

A core intended to be used as a support for a roll of paper, especially toilet paper, is formed by winding at least one strip made of tissue, the strip being impregnated, at least locally, with starch so as to improve its stiffness. Thus configured, a core is provided having both a mechanical strength suitable for the envisaged use and a greatly improved ability to disintegrate relative to a cardboard core so as to allow it to be able to be disposed of directly in a toilet bowl without risk of blocking the soil pipe.

7 Claims, 2 Drawing Sheets

(56) References Cited

U.S. PATENT DOCUMENTS

| | | | | |
|---|---|---|---|---|
| 6,299,607 | B1 * | 10/2001 | Osborn et al. | 604/385.02 |
| 7,951,440 | B2 | 5/2011 | Butler, III | |
| 8,075,699 | B2 | 12/2011 | Butler, III | |
| 2003/0034117 | A1 * | 2/2003 | Thomas et al. | 156/195 |
| 2004/0248486 | A1 | 12/2004 | Hodson | |
| 2005/0271839 | A1 * | 12/2005 | Pierce et al. | 428/34.2 |
| 2007/0048474 | A1 * | 3/2007 | Butler et al. | 428/36.9 |
| 2009/0075001 | A1 | 3/2009 | O'Neill | |

OTHER PUBLICATIONS

PCT Search Report for Application No. PCT/FR2008/000826 filed Jun. 13, 2008; Date of Mailing: Jan. 14, 2009; 7 pgs.

PCT Written Opinion of the International Searching Authority for Application No. PCT/FR2008/000826 filed Jun. 13, 2008; 8 pgs.

English translation of the Written Opinion of the International Searching Authority that issued in PCT/FR2008/000826 on Jan. 27, 2010.

* cited by examiner

CORE INTENDED TO BE USED AS A SUPPORT FOR A ROLL OF PAPER

CROSS-REFERENCE TO PRIOR APPLICATION

This application is a continuation application of pending prior U.S. patent application Ser. No. 12/601,448, filed Nov. 23, 2009, which is the National Stage of International Application No. PCT/FR2008/000826 filed Jun. 13, 2008, and claims benefit of French Application No. 0704233 filed Jun. 14, 2007, which are all herein incorporated by reference in their entirety.

BACKGROUND OF THE INVENTION

The invention relates to a core intended to be used as a support for a roll of paper, especially toilet paper.

In the field of paper intended for domestic use, especially toilet paper or kitchen towel, it is known to present them in the form of rolls. Said rolls are formed by winding the paper around a core that is generally made of cardboard.

The choice of cardboard results in fact from the compromise sought by the manufacturers between the ability of the material to cope with the mechanical stresses during manufacture and the desire to limit the cost of the product in the end. Indeed, it turns out that these cores, during the manufacture of the rolls, are subjected to diverse mechanical stresses whether this is during their time in the winding machine, during the packaging of the rolls into packets or during stacking of the packets of rolls on pallets intended to transport them. The material that forms these cores must in particular have good stiffness characteristics to withstand the loads and stresses to which the rolls are subjected throughout their production and distribution cycle. A material that does not have sufficient strength would indeed cause a deformation of individual rolls or else a collapse of the stacks of rolls on the pallets. This would therefore have particularly detrimental consequences for the quality of the products obtained or for the overall production yield of these rolls.

Until now, cardboard has formed a quite suitable solution to these requirements. It has, in addition, the advantage of being relatively inexpensive.

However, this type of cardboard core now proves unsuitable to the new requirements of consumers to have an easily disposable material, especially one which can be thrown away down toilet bowls.

Indeed, the consumer has for a long time been used to throwing away sections of toilet paper, after use, in the toilet bowl and of then flushing to dispose of them into the soil pipe. This generally does not result in any obstruction of said pipe, given that the material made of tissue paper forming these sections disintegrates easily and rapidly in the presence of water.

The same operation can no longer be applied, however, when it is a question of disposing of the cardboard core, once the whole supply of paper has been used. This is because cardboard, being a material that is a lot less absorbent than tissue paper, disintegrates very slowly, and with great difficulty, in water. It results in an almost definite blockage of the soil pipe of toilets, when the toilet is flushed just after said core has been thrown into the bowl.

The only alternative is therefore to favour a disposal of the core in an outside dustbin. This solution however has the major drawback of needlessly increasing the amount of waste produced by all the consumers. For want of being separated from other household waste, these cardboard cores are often not recycled or recyclable. This therefore results in a significant increase in the volume of waste to be destroyed or to be stored at dumps, which goes against the current ecological concerns of our modern societies.

The present invention therefore aims to solve the problems raised by this prior art and, in particular, to provide a core which may easily disintegrate in toilets.

BRIEF DESCRIPTION OF THE INVENTION

In view of the foregoing and according to an embodiment of the invention, a core is provided that is intended to be used as a support for a roll of paper, especially toilet paper, characterized in that it is formed by winding at least one strip made of tissue, the strip being impregnated, at least locally, with starch so as to improve its stiffness.

According to one particular embodiment of the invention, the degree of impregnation of the tissue strip is between 0.05 and 0.50 g of starch per gram of tissue.

According to another particular embodiment of the invention, the degree of impregnation of the tissue strip is between 0.25 and 0.45 g of starch per gram of tissue.

According to yet another particular embodiment of the invention, the core has a flat crush resistance which is lower, by 5% or less, than that of a similar core made of cardboard.

According to a further particular embodiment of the invention, the tissue strip comprises several layers of tissue separated from each other by adhesive layers.

According to another particular embodiment of the invention, at least some of said adhesive layers contain a mixture of adhesive and starch.

According to yet another particular embodiment of the invention, the tissue strip comprises between 2 and 24 layers of tissue and, preferably, between 4 and 16 layers of tissue.

An embodiment of the invention also relates to a method of manufacturing a core as defined previously, comprising the following steps:

a) supplying a first strip made of tissue comprising one or more plies;
b) supplying a second strip made of tissue comprising one or more plies;
c) depositing an adhesive layer on at least one outer surface of the first strip, said adhesive layer improving the stiffness of the complex formed by the assembly of the first and the second strip once dried;
d) simultaneous assembly and pressing of the first strip with the second strip so that the outer surface of the first strip covered with an adhesive layer comes into contact with one outer surface of the second strip, the assembly obtained forming, at the end, a third strip;
e) drying the third strip;
f) use of the third strip in replacing the first and/or the second strip in steps a) to d);
g) repetition of steps a) to e) until a third strip having the desired number of plies is obtained;
h) optional coating of the outer faces of the third strip with at least one starch-based layer;
i) spirally winding the third strip around itself or with a fourth strip identical to the third strip in the form of a hollow tube; and
j) cutting a section of said tube to form the core.

Thus configured, an embodiment of the invention is capable of providing a core having both a mechanical strength suitable for the envisaged use and a greatly improved ability to disintegrate relative to a cardboard core so as to allow it to be able to be disposed of directly in a toilet bowl without risk of blocking the soil pipe.

BRIEF DESCRIPTION OF THE DRAWINGS

Other advantages and features will stand out better from the description that follows of an example embodiment according to the invention, with reference to the drawings in which.

DETAILED DESCRIPTION OF THE INVENTION

Starch includes natural products of plant origin such as wheat starch, corn starch, potato starch, rice starch, tapioca starch, sorghum starch and others, composed of high molecular weight polymers or polyholosides. Starch is also understood to mean products derived from natural starch, converted by physical treatment, for example heating, physicochemical treatment or biological treatment, for example enzymatic treatment, and derived or modified starches such as cationic, anionic, amphoteric, non-ionic or crosslinked starches.

The tissue strip comprises several layers of tissue, each layer having a basis weight of approximately 80 g/m$^2$ and preferably from approximately 20 to approximately 40 g/m$^2$.

Figure 1:
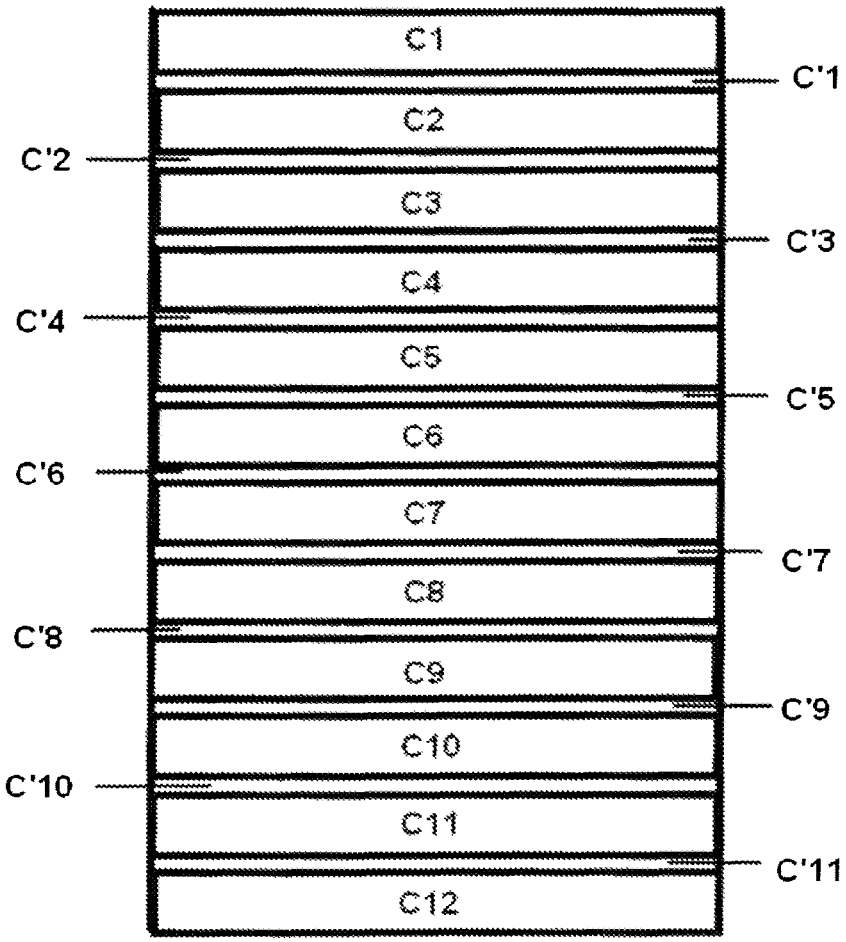
FIG. 1 represents a schematic transverse cross-sectional view of a tissue strip forming a core according to an embodiment of the invention.

With reference to FIG. 1, the structure of a tissue strip intended to form the core of an embodiment of the invention is represented schematically.

This structure is composed of the stack of 12 tissue layers Cn joined together by means of 11 adhesive layers C'n.

Each of the tissue layers Cn has a basis weight of 20 g/m$^2$.

Each of the adhesive layers C'n is formed either from a mixture of adhesive based on polyvinyl alcohol and polyethylene glycol of the SWIFT® L998/4 type sold by Forbo and of potato starch of the AMYLOGUM CLS® type sold by Avebe, or solely from potato starch of the AMYLOGUM CLS® type.

The weight of adhesive and starch in each of the layers C'n is given in Table 1 below.

TABLE 1

| Layer | Weight of adhesive (in g/m$^2$) | Weight of starch (in g/m$^2$) |
|---|---|---|
| C'1 | 0 | 1.5 |
| C'2 | 0.04 | 1.66 |
| C'3 | 0 | 1.5 |
| C'4 | 0.05 | 2.04 |
| C'5 | 0 | 1.56 |
| C'6 | 0.04 | 1.66 |
| C'7 | 0 | 1.5 |
| C'8 | 0.05 | 2.01 |
| C'9 | 0 | 1.5 |
| C'10 | 0.04 | 1.66 |
| C'11 | 0 | 1.5 |

Subsequently, each of the outer faces of this strip were coated twice with a solution of starch on the same type as that used in the adhesive layers C'n.

Thus, deposited respectively on the layers C1 and C12 were 3.9 g/m$^2$ and 3.45 g/m$^2$ of starch.

It was determined that the strip had been impregnated, at the end, according to a level of 0.11 g of starch per gram of tissue.

Said strip was then wound with another exactly similar strip to form a core. The core obtained was subjected to a series of tests in order to evaluate its mechanical strength and its ability to disintegrate.

Similar tests were carried out on a commercial cardboard core, having the same thickness and the same length as the core of the invention and being formed from a single strip whose basis weight was around 280 g/m$^2$.

Compression Test:

The flat crush resistance and the edgewise compressive strength of the core were measured by using the following method.

The core to be tested was first cut along a cylindrical portion delimited by two opposite faces, perpendicular to the axis of the cylinder, said portion having a length of 50 mm along a direction parallel to the axis.

This cylindrical portion was then positioned between the two metal plates of a dynamometer, said plates being parallel to one another and separated at the beginning by a distance slightly greater than the length of the cylindrical portion, in the case of measuring the edgewise compressive strength, or slightly greater than its diameter, in the case of measuring the flat crush resistance.

In the edgewise compressive strength measurement, the cylindrical portion was placed so as to orientate the axis of the cylinder along a direction perpendicular to the plane formed by one or other of the plates.

In the flat crush resistance measurement, the cylindrical portion was placed so as to orientate the axis of the cylinder along a direction parallel to the plane formed by one or other of the plates.

Next, said cylindrical portion was compressed between the two plates, the compression rate being 10 mm/min.

At the same time the resistance put up by the core was measured up to its maximum Rmax, that is to say just before the core was irreversibly destroyed.

5 measurements were carried out each time and the average of these was calculated.

The results are given in Table 2 below.

TABLE 2

| | Core of the invention | Similar cardboard core | Ratio between the two values |
|---|---|---|---|
| Flat crush resistance | Rmax = 4.89N | Rmax = 5.15N | 0.95 |
| Edgewise compressive strength | Rmax = 153N | Rmax = 278N | 0.55 |

It was therefore observed that the core according to the invention had a flat crush resistance approximately equal to that of a similar cardboard core.

Given that the main stresses undergone by the core during its production and distribution cycle are predominantly exerted as flat crush stresses, it may be considered that the core of the invention completely meets these needs.

Disintegration Test:

The ability of the core to disintegrate was measured according to the NF Q34-020 standard with and without stirring.

The results are given in Table 3 below.

It was therefore observed that the core according to the invention disintegrates at least 10 times more quickly than a similar cardboard core formed from a single strip having a basis weight equal to 280 g/m$^2$, whether this is with stirring or without stirring.

It was also observed that the core begins to disintegrate in water at least twenty times more quickly than a similar core made of cardboard obtained by winding a single strip of cardboard having a basis weight of 280 g/m$^2$ The term "similar core" should be understood to mean a core having approximately the same diameter and the same length as the core of the invention.

TABLE 3

| | Core of the invention | Similar cardboard core |
|---|---|---|
| NF Q34-020 (with stirring) | the core begins to disintegrate before 5 sec<br>the core is completely disintegrated after around 60 sec (fibrous suspension) | the core begins to disintegrate at around 3 min<br>the core is completely disintegrated after 10 min (pieces ≤ 1 cm$^2$) |
| NF Q34-020 (without stirring) | the core is completely wetted in 4 sec<br>the coils begin to open after 30 sec | the core is completely wetted in 160 sec<br>the coils begin to open after 10 min |

Discharge Test:

A coil was placed in a domestic sewage system formed from a toilet bowl connected to a pipe network having a total length of 18 m.

A certain amount of water was disgorged using a conventional flush device leading into the bowl so as to discharge the core out of the bowl and to make it travel the entire 18 m of pipes.

The amount of water needed for this discharge was measured both for a core of the invention and for a similar cardboard core formed from a single strip having a basis weight equal to 280 g/m$^2$.

In the case of the core according to the invention, it required around 6 l of water so that the core was discharged out of the bowl and traveled the 18 m of pipes.

In the case of the similar cardboard core, the core did not travel the entire 18 m of pipes even after having disgorged more than 50 l of water.

Figure 2:
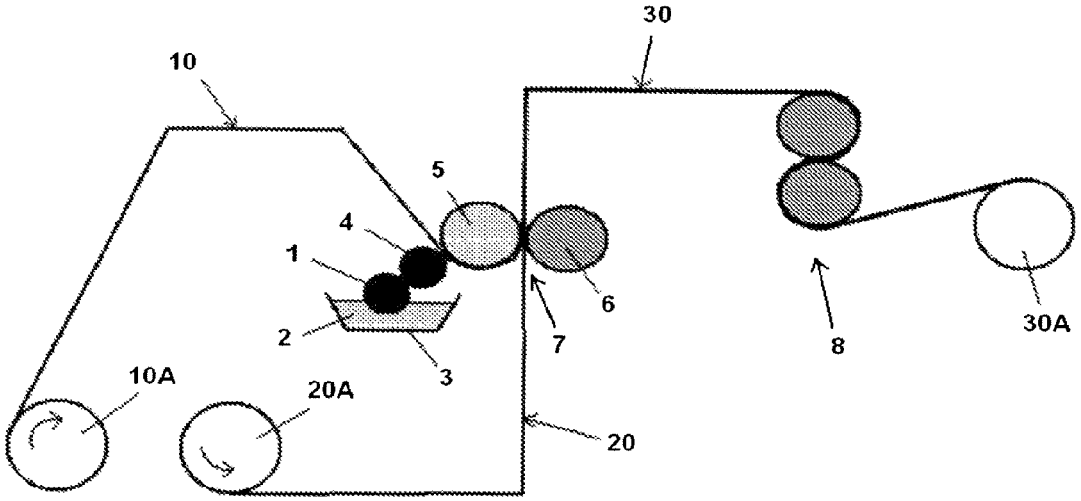
FIG. 2 schematically represents an example installation intended to form the tissue strip from FIG. 1 in accordance with an embodiment of the invention.

With reference to FIG. 2, an installation intended to form the tissue strip that makes up the core of the invention is represented schematically.

A first strip 10 of tissue paper that only comprises a single ply is fed from a first reel 10A in the direction of an adhesive station. Said station comprises an engraved roll 1 dipping into an adhesive solution 2 based on adhesive and starch contained in a storage reservoir 3, said roll 1 subsequently transferring said adhesive solution 2 to an applicator roll 4.

During the passage of the first strip 10, said applicator roll 4 is brought into contact with one of the outer surfaces of this strip 10 so as to deposit an adhesive layer on said outer face.

Once coated with adhesive, said first strip 10 is pressed with a second strip 20 of single-ply tissue paper fed from a second reel 20A, so that the adhesive layer is trapped between said two strips 10 and 20. The pressing station is composed of a smooth steel roll 5 and an elastomeric roll 6 having a Shore A hardness of around 95, separated so as to create a nip 7 through which the assembly of the first and second strips 10 and 20 travels.

This results in the formation of a third strip 30 at the outlet of the pressing station, which comprises two outer plies of tissue paper and one internal adhesive layer.

Said third strip 30 is then dried at a temperature of 140° C. by passing into a calendering station 8 formed by two heated rolls and finally wound in the form of a third reel 30A.

Depending on the number of plies that the strip of tissue paper will have to have at the end, it will optionally be appropriate to use this third reel 30A in place of the first reel 10A and/or the second reel 20A and to again repeat the steps mentioned previously. Thus, it will be possible to repeat the operation below as many times as necessary in order to obtain a strip of tissue paper having exactly the desired number of plies.

Subsequently, and by using an additional coating station (not shown), each of the outer faces of the strip obtained are coated with one or more starch-based layers, which will give it an improved stiffness.

The thus starched strip forms the base material used during the formation of the core. This type of core is generally formed by spirally winding one or more strips around a shaft. The resulting hollow tube is then cut into sections of equal length, each of the sections forming a core according to the invention.

In place of the method described above, it can also be envisaged to carry out a simultaneous winding of several strips of tissue paper using a winding device comprising as many feeding posts as there are strips to be wound, the number of strips corresponding to the number of layers of tissue that it is desired to incorporate into the core.

Depending on the mechanical strength, especially the compressive strength, that it is desired to obtain for this core, and also on its ability to disintegrate more or less easily and rapidly, it can be envisaged to vary the number of layers of tissue paper from which each of the strips will be formed and the total amount of starch with which each of the strips are impregnated.

In particular, it turns out that a desirable solution consists in using between 2 and 24 layers of tissue paper, and preferably, between 4 and 16 layers of tissue paper.

Furthermore, the strip will be impregnated with starch up to a level of at least 0.1 g of starch per gram of tissue and preferably between 0.25 and 0.45 g per gram of tissue.

The invention claimed is:

1. A core for supporting a roll of paper, comprising:

at least one strip of tissue wound to form a hollow tube, said strip comprising at least one alternation of one ply of tissue in direct contact with a separate non-fibrous layer of starch so as to improve its stiffness, wherein each alternation contains between 0.05 and 0.50 g of starch comprised in the separate non-fibrous layer of starch per gram of ply of tissue.

2. The core according to claim 1, wherein each alternation contains between 0.25 and 0.45 g of starch comprised in the separate non-fibrous layer of starch per gram of ply of tissue.

3. The core according to claim 1, wherein at least one of the non-fibrous layers contains a mixture of adhesive and starch.

4. The core according to claim 1, wherein the strip comprises between 2 and 24 plies of tissue.

5. The core according to claim 1, wherein the strip comprises between 4 and 16 plies of tissue.

6. The water soluble core according to claim 1, wherein the water soluble core begins to disintegrate in five seconds or less of being placed in an aqueous solution with stirring.

7. The water soluble core according to claim 1, wherein the water soluble core disintegrates in sixty seconds or less of being placed in an aqueous solution with stirring.

* * * * *